US005522115A

United States Patent [19]

Webster

[11] Patent Number: 5,522,115

[45] Date of Patent: Jun. 4, 1996

[54] BLOWER VACUUM

[75] Inventor: Craig D. Webster, Jesmond, United Kingdom

[73] Assignee: Black & Decker Inc., Newark, Del.

[21] Appl. No.: 442,852

[22] Filed: May 17, 1995

[30] Foreign Application Priority Data

May 18, 1994 [GB] United Kingdom ..... 9409909

[51] Int. Cl.[6] ..... A47L 5/18

[52] U.S. Cl. ..... 15/330; 15/338; 15/344; 15/405; 15/409

[58] Field of Search ..... 15/330, 405, 344, 15/409, 338

[56] References Cited

U.S. PATENT DOCUMENTS

| | | | |
|---|---|---|---|
| 4,290,165 | 9/1981 | Hiramatsu et al. | 15/409 X |
| 4,325,163 | 4/1982 | Mattson et al. . | |
| 4,663,799 | 5/1987 | Kiyooka | 15/330 |
| 4,817,230 | 4/1989 | Kiyooka . | |
| 5,410,775 | 5/1995 | Frazier | 15/338 |

FOREIGN PATENT DOCUMENTS

| | | |
|---|---|---|
| 0114114 | 7/1984 | European Pat. Off. . |
| 0198654 | 10/1986 | European Pat. Off. . |
| 0443882 | 8/1991 | European Pat. Off. . |
| 0587272 | 3/1994 | European Pat. Off. . |

*Primary Examiner*—Chris K. Moore
*Attorney, Agent, or Firm*—Charles E. Yocum; Dennis A. Dearing; John D. Del Ponti

[57] ABSTRACT

A blower vacuum unit for selective operation in a blower mode and in a suction mode, comprises: a housing having means forming an air inlet and means forming an air outlet; a motor carried within the housing, an impeller rotatably driven by the motor and positioned for drawing air into the housing through the air inlet and discharging the air from the housing through the air outlet; a debris collection conduit one end of which conduit is an operating end and the other end of which conduit is adapted for attachment to a debris collection container and means for generating an entrained air flow, using the air discharged through the air outlet, at the operating end of the debris collection conduit into the debris conduit. The housing and the debris collection conduit comprise separate components and the conduit is adapted to be releasably mounted on the housing so that the operating end of the conduit is located for co-operation with the air outlet of the housing.

10 Claims, 2 Drawing Sheets

BLOWER VACUUM

BACKGROUND OF THE INVENTION

The present invention relates to a debris collecting apparatus, in particular a garden debris collecting apparatus, of the kind which may be used either in a vacuum mode to suck debris into the apparatus or in a blowing mode to discharge a stream of air from a nozzle so that debris can be blown into piles.

Such debris collecting apparatus is already known. In one such apparatus, according to U.S. Pat. No. 4,325,163, a centrifugal impeller is used to take in air through an inlet and blow it through an outlet. In the vacuum mode, debris passes through the impeller, which will inevitably result in wear to the impeller, even though a chopping blade may be mounted on the impeller shaft immediately upstream of the impeller.

It is also known, for example from European Patent No 114,114, to provide a debris collection apparatus in which an impeller is used to create an entrained air flow. In the vacuum mode, debris is picked up in this entrained air flow and carried via a duct to a collecting bag. The debris does not pass through the impeller, thus reducing wear and tear to the impeller. Such a system, however, does have the disadvantage that where the apparatus is being used in the blowing mode, and it is not desired to collect debris, the collecting bag and duct are still attached to the blower, which makes the apparatus heavier and less manoeuvrable for the user.

It is an object of the present invention to provide a debris collecting apparatus in which the above disadvantages are reduced or substantially obviated.

BRIEF DESCRIPTION OF THE INVENTION

The present invention therefore provides:

a blower vacuum unit for selective operation in a blower mode and in a suction mode, comprising:

a housing having means forming an air inlet and an air outlet;

a motor carried within the housing, an impeller rotatably driven by the motor and positioned for drawing air into the housing through the air inlet and discharging the air from the housing through the air outlet;

a debris collection conduit one end of which conduit is an operating end and the other end of which conduit is adapted for attachment to a debris collection container and means for generating an entrained air flow, using the air discharged through the air outlet at the operating end of the debris collection conduit into the debris conduit characterised in that the housing and the debris collection conduit comprise separate components and the conduit is adapted to be releasably mounted on the housing so that the operating end of the debris conduit is located for co-operation to the air outlet of the housing.

If it is desired that the collection apparatus can be selectively used in the blowing mode with the debris conduit attached, then a switch arrangement, known per se, may be provided by which the apparatus can be converted from the blowing to the collecting mode.

The present invention further provides a blower vacuum unit for selective operation in a blower mode and in a suction mode, comprising:

a housing having means forming an air inlet and an air outlet;

a motor carried within the housing, an impeller rotatably driven by the motor and positioned for drawing air into the housing through the air inlet and discharging the air from the housing through the air outlet;

a debris collection conduit one end of which conduit is an operating end and the other end of which conduit is adapted for attachment to a debris collection container and means for generating an entrained air flow, using the air discharged through the air outlet, at the operating end of the debris collection conduit into the debris conduit characterised in that the housing and the debris collection conduit comprise separate components and the conduit is adapted to be releasably mounted on the housing so that the operating end of the conduit is located for co-operation with the air outlet of the housing.

BRIEF DESCRIPTION OF THE DRAWINGS

An embodiment of a debris collection apparatus according to the invention will now be further described with reference to the accompanying drawings, in which.

DETAILED DESCRIPTION

Figure 1:
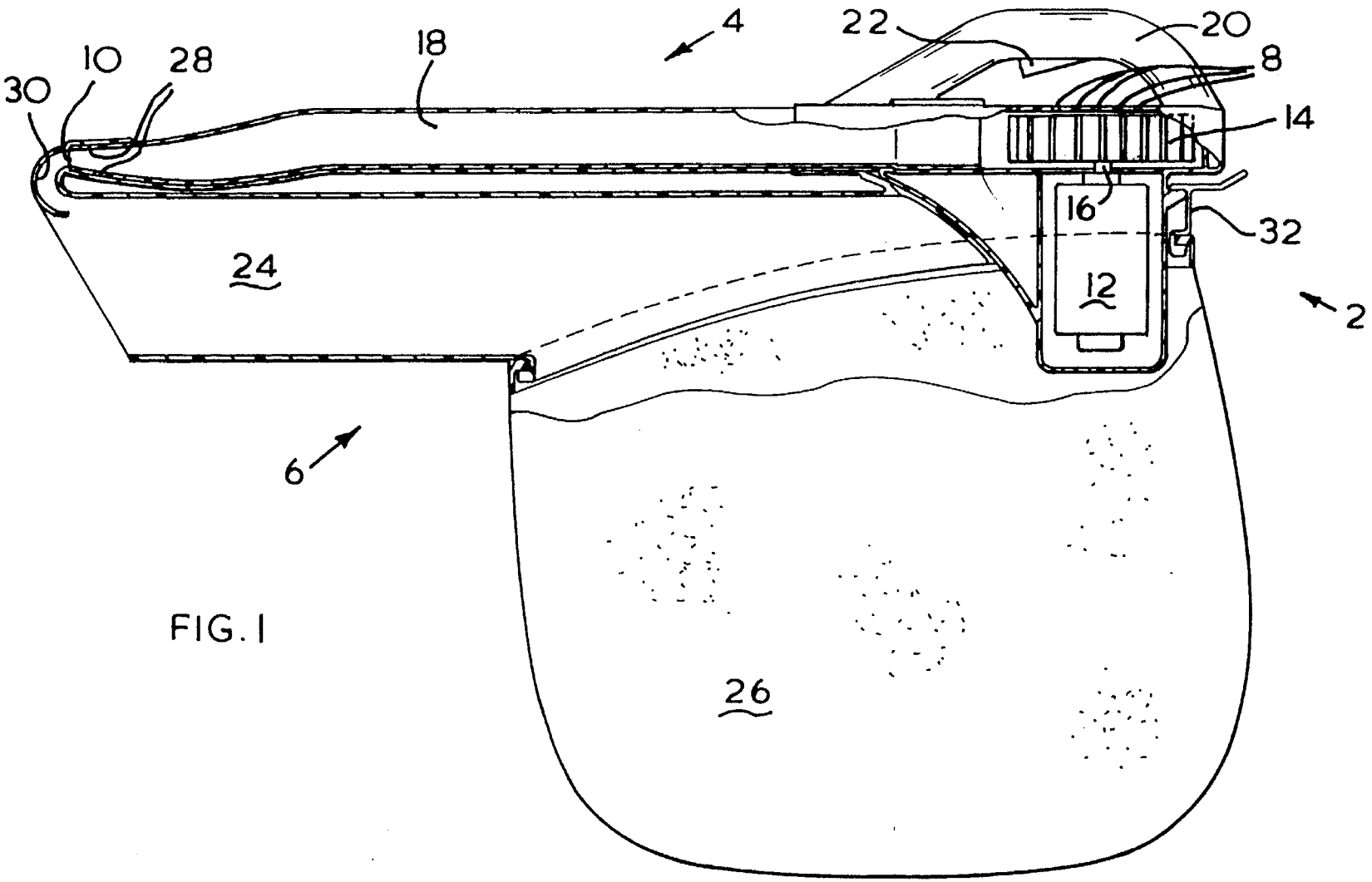
FIG. 1 is a sectional view of the apparatus with the debris conduit and debris collection container attached.

As can be seen from FIG. 1, a blower vacuum unit (2) comprises a blower housing (4) and a debris collection unit (6). The blower housing (4) comprises slits (8) forming an air inlet and a nozzle (10) forming an air outlet.

A motor (12) is located within the housing (4) and an impeller (14) is mounted for rotation on an output shaft (16) of the motor, adjacent to the air inlet slits (8).

The air inlet slits (8) are located at one end of the housing (4) with the outlet nozzle (10) located at the far end. The slits (8) and nozzle (10) are connected by a conduit portion (18) of the housing (4).

A handle (20) is mounted n the housing (4) at the end of the conduit portion (18) remote from the nozzle (10), and an on/off switch (22) controlling the supply of electrical power to the motor (12) is provided in this handle.

The debris collection unit (6) comprises a debris collection conduit (24) and collection bag (26). The conduit (24) is shaped at one end (26) to provide a socket (28) to receive the nozzle (10) of the blower housing (4). The socket (28) is connected via a deflecting surface (30) into the debris collection conduit (24).

Releasable clip means (32) is provided to secure the blower housing (4) to the collection unit (6).

Figure 2:
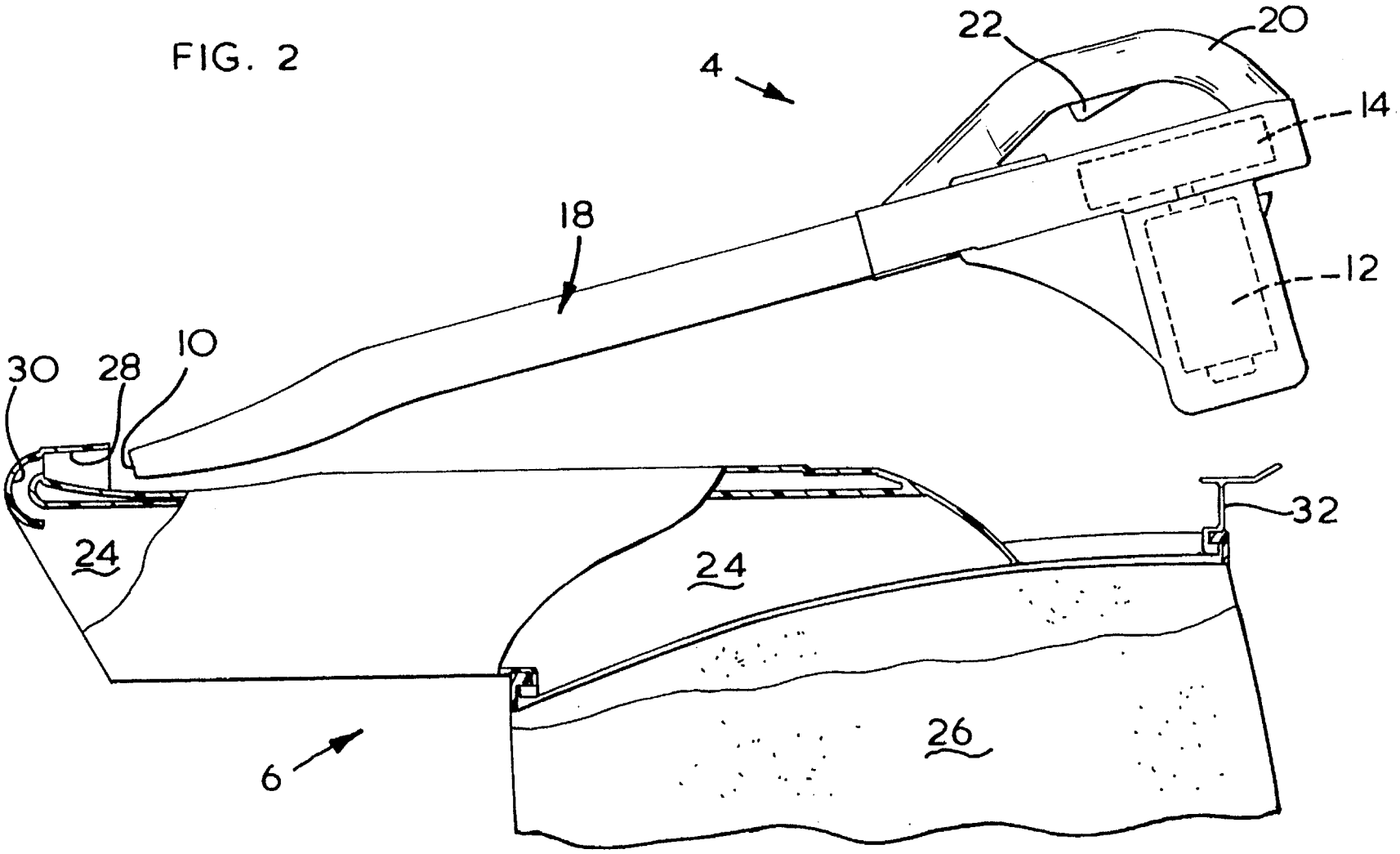
FIG. 2 is a view of the apparatus partially in section with the debris conduit and debris collection container positioned for attachment to the blower unit.

As can be seen from FIG. 2, the blower housing 4 is detachable from the debris collection unit 6. In order to attach the blower housing (4) to the debris collection unit (6), the nozzle (10) of the housing (4) is located in the socket (28) and the clip mechanism (32) engaged.

A seal preferably made of a resilient material such as an O-ring or foam ring is suitably provided in the socket (28) to improve the sealing between the nozzle (10) and the socket (28).

The deflecting surface (30) may be provided with a switch means (not shown) by which the air flow can be selectively directed either to create a vacuum flow or as a blower, when the collection unit (6) is attached to the housing (4).

I claim:

1. A blower vacuum unit for selective operation in a blower mode and in a suction mode, comprising:

a housing having means forming an air inlet and means forming an air outlet;

a motor carried within said housing, an impeller rotatably driven by said motor and positioned for drawing air into said housing through said air inlet and discharging said air from said housing through said air outlet;

a debris collection conduit one end of which conduit is an operating end and the other end of which conduit is adapted for attachment to a debris collection container and means for generating an entrained air flow, using the air discharged through said air outlet, at said operating end of said debris collection conduit into said debris conduit, wherein said housing and said debris collection conduit comprise separate components and said conduit is adapted to be releasably mounted on said housing so that said operating end of the conduit is located for co-operation with said air outlet of said housing and wherein the housing, motor and impeller operate in a suction mode when said debris collection conduit is mounted thereon, and in a blower mode when said debris collection conduit is not mounted thereon.

2. A blower vacuum unit according to claim 1 wherein said unit further comprises a debris collection container.

3. A blower vacuum unit according to claim 1 wherein said debris collection conduit and said debris collection container together comprise a single component.

4. A blower vacuum unit according to claim 1 wherein said unit further comprises a switch arrangement so that said unit can selectively be used in the blowing or collecting mode with said debris conduit attached.

5. A blower vacuum unit according to claim 1 wherein said debris collection container is free-standing when detached from said blower unit.

6. A blower vacuum unit according to claim 1 wherein a seal is provided between said operating end of the debris collection conduit and said housing.

7. A blower vacuum unit according to claim 6 wherein said seal is a resilient material.

8. A blower vacuum according to claim 1 further comprising means for comminution of the debris collected.

9. A blower vacuum unit according to claim 8 wherein said means for comminution of the debris is located within said debris conduit.

10. A blower unit comprising:

a housing having means forming an air inlet and means forming an air outlet;

a motor carried within said housing, and an impeller rotatably driven by said motor and positioned for drawing air into said housing through said air inlet and discharging said air from said housing through said air outlet;

wherein said housing is provided with means for releasably mounting a debris collection conduit, one end of which conduit is an operating end and the other end of which conduit is adapted for attachment to a debris collection container so that said operating end of the conduit is located for co-operation with said air outlet of said housing.

* * * * *